US005876319A

United States Patent [19]

Holton

[11] Patent Number: 5,876,319

[45] **Date of Patent: *Mar. 2, 1999**

[54] CONTAINER FORMING METHOD AND APPARATUS

[75] Inventor: David B. Holton, Sanger, Calif.

[73] Assignee: Delaware Capital Formation, Inc., Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 484,962

[22] Filed: Jun. 7, 1995

[51] Int. Cl.[6] ..... B31B 17/26

[52] U.S. Cl. ..... 493/84; 493/120; 493/122; 493/130; 493/140; 493/143; 493/167; 493/168; 493/176; 493/177; 493/180

[58] Field of Search ..... 493/84, 120, 122, 493/128, 130, 140–143, 156, 157, 162, 163, 166–168, 174–177, 180, 114

[56] References Cited

U.S. PATENT DOCUMENTS

| | | | |
|---|---|---|---|
| 1,697,709 | 1/1929 | Bliss . | |
| 1,974,527 | 1/1934 | Bliss . | |
| 3,186,244 | 6/1965 | Baker et al. | 493/167 |
| 3,196,761 | 7/1965 | Ullman | 493/122 |
| 3,318,205 | 5/1967 | Lefief | 493/174 |
| 3,456,563 | 7/1969 | Roesner et al. | 493/114 |
| 3,465,652 | 9/1969 | Bell et al. | 493/114 |
| 3,521,536 | 7/1970 | Waldbauer et al. | 493/168 |
| 3,590,700 | 7/1971 | Paxton | 493/128 |
| 3,626,819 | 12/1971 | Hoypup | 493/167 |
| 3,635,129 | 1/1972 | Cobelo, Jr. | 493/143 |
| 3,638,537 | 2/1972 | Cato | 493/167 |
| 3,808,959 | 5/1974 | Perry | 493/141 |
| 3,821,875 | 7/1974 | Paxton . | |
| 3,858,489 | 1/1975 | Paxton | 493/174 |
| 3,935,798 | 2/1976 | Paxton . | |
| 3,941,037 | 3/1976 | Reichert | 493/167 |

(List continued on next page.)

OTHER PUBLICATIONS

Fibre Box Handbook. Fibre Box Association, 1992, pp. 17–32D ("box styles"); pp. 10–11 (box manufacturing).

Corrugated and Solid Fibre Tray and Bliss Box Forming Machines, SWF Machinery, Inc. publication.

Bliss Matic (brochure), SWF Machinery, Inc. publication Bliss Designs That Display (flyer), SWF Machinery publication.

*Primary Examiner*—Michael J. Carone
*Assistant Examiner*—Darren Ark
*Attorney, Agent, or Firm*—Mark D. Miller

[57] ABSTRACT

A machine for forming a variety of different sturdy, stackable three-part fiberboard containers having a depth dimension greater than their width dimension, and which are suitable for holding bags filled with liquid. The machine includes a slidable, removable mandrel which cycles between a fiberboard hopper area and a container forming compression area. Each of two side bins provides a fiberboard end panel which comes into contact with independently slidable edge picks on the mandrel. Just before the mandrel cycles forward, the edge picks push the fiberboard end panels forward where they are bent by the action of two folding elements. Meanwhile, a fiberboard body matt is brought into position in front of the retracted mandrel from an overhead feed unit. Adhesive material is sprayed onto selected parts of the body matt as it is placed into position in front of the mandrel. As the mandrel cycles forward, the body matt is bent over into a C-shape and the now-folded end panels are pushed into close association with the middle of the body matt. A set of guides and plows bends the body matt flaps over the end panels forming sturdy corners. The compression plates loosely surround the bent fiberboard pieces in order to avoid early adhesion until the mandrel is fully extended forward bringing the fiberboard pieces into proper position. Once positioned, the compression plates collapse around the fiberboard pieces forming a finished container. The finished container is then displaced as the machine cycles back to form another container.

27 Claims, 11 Drawing Sheets

U.S. PATENT DOCUMENTS

| | | | |
|---|---|---|---|
| 4,023,471 | 5/1977 | Royal | 493/167 |
| 4,197,789 | 4/1980 | Moen | 493/167 |
| 4,273,322 | 6/1981 | Ginther, Sr. et al. | 493/122 |
| 4,283,188 | 8/1981 | Wingerter et al. | 493/120 |
| 4,596,542 | 6/1986 | Moen | 493/176 |
| 4,988,331 | 1/1991 | Boisseau | 493/143 |
| 5,104,368 | 4/1992 | Arbuthnot | 493/84 |
| 5,156,583 | 10/1992 | Baas | 493/140 |
| 5,312,316 | 5/1994 | Wu | 493/141 |
| 5,419,485 | 5/1995 | Petriekis et al. . | |
| 5,656,006 | 8/1997 | East et al. | 493/171 |
| 5,656,007 | 8/1997 | Olson et al. | 493/84 |

CONTAINER FORMING METHOD AND APPARATUS

BACKGROUND OF THE INVENTION

1. Field of the Invention

The present invention relates to container forming machines, and in particular to a new and improved method and apparatus for forming, erecting elongated Bliss-style containers from pre-cut material blanks.

2. Description of the Prior Art

There is an ever increasing need for better containers to hold commodities having various sizes, shapes and dimensions such as fresh fruits and vegetables, canned and bottled goods, and a wide variety of other products. As new products are developed, new requirements for packing, shipping and storing various quantities of such products arise. Every time such requirements arise, or a new product is developed, there is a need for a new container design, as well as a machine to manufacture it.

In the packaging industry, numerous fiberboard containers and designs have been developed over the years. Such containers are typically constructed of a corrugated material. These materials may be single face corrugated, single wall (double-faced) corrugated, double wall corrugated, triple wall corrugated, etc. Containers may also be made of other paperboard products including, without limitation, container board, boxboard, linerboard, and cardboard.

Many different container box styles and types have also been developed over the years, each being optimally suited for one or more particular products or industries. Slotted box styles include such types as regular slotted containers (RSC), overlapped slotted containers (OSC), full-overlapped slotted containers (FOL), center special slotted containers (CSSC), bag-in-box containers, center special overlapped slotted containers (CSO or CSOSC), center special full-overlapped slotted containers (SFF), and snap-bottom boxes, among others. Telescoping boxes include such types as full-telescope design-style boxes (FTD), full-telescope half-slotted boxes (FTHS), partial-telescope design-style boxes (PTD), partial-telescope half-slotted boxes (PTHS), design-style boxes with cover (SDC), half-slotted boxes with cover (HSC), double-covered boxes (DC), interlocking-covered boxes (IC), bulk bins, and double-thickness score-line boxes, among others. Folder style boxes include such types as one-piece folders (1PF), two-piece folders (2PF), three-piece folders (3PF), four-piece folders (4PF), wrap-around blanks, self-locking trays, tuck folders, and one-piece telescopes (1PT) among others. Slide-type boxes include such types as double-side boxes (DS), and triple-side boxes (TS), among others. Rigid boxes include Bliss boxes and recessed-end boxes, among others. There are also self-erecting boxes, and numerous interior forms for boxes.

In the industry, the terms "case" and "box" are often used interchangeably. These terms each refer to a large, usually rectangular container made out of paperboard which is designed to hold a given number (e.g. 12 or 24) of smaller units such as cartons, bottles, cans, or produce pieces.

Bliss-type boxes have special characteristics which make them highly desirable for use in bulk packing industries such as meats, explosives, fresh fruits and vegetables, and other areas where strong construction and stacking strength are important. Bliss boxes were first developed in the 1920s, and were the subject of a number of early U.S. patents (e.g. U.S. Pat. Nos. 1,697,709 and 1,974,527). Generally speaking, a Bliss box is made of three distinct pieces of paperboard material. The first is an elongated piece of material, sometimes called a body matt, which is folded around itself in the shape of a rectangular tube forming the bottom, sides and top of the final box. Two separate end panels, usually mirror-images of each other, are attached to the open end of the larger piece to form the completed Bliss box. The corners of the side panels typically fold over the corners of the front and back panels of the body matt on the outside, giving the Bliss style of box good corner and stacking strength. The bottom of the Bliss box is solid which avoids the need for bottom sealing.

Because of its three-part construction, Bliss style boxes offer a wide range of variations in both construction and materials. For example, the end panels may or may not include upper flaps for closing the top of the box. The body matt may include two large flaps (one on either side) to form the top of the box so that these flaps either meet or overlap; or, there may be only one large top flap (with or without a tuck-in lip) provided to form the top of the Bliss box. Top flaps from the side panels may or may not be provided, or some other suitable combination of large or small flaps from the side panels and body matt may be employed.

Similarly, the corner-area overlaps provided by the side panels may vary widely depending upon the degree of strength required. In some Bliss box variations, flaps are provided along the sides of the body matt so that, when the body matt is folded over itself, these flaps create a frame on either end to which the side panels may be attached (on the inside of the body matt). This way, instead of side-panel flaps overlapping the outside of the body matt corners for attachment and strength, body matt flaps in these corners overlap the side panels. Such frames may be made with panels along both sides as well as the bottom end of the body matt. In many cases, the side panels and the body matt may be made of different paperboard materials (e.g., corrugated body matt and linerboard side panels). The overlapping areas of Bliss boxes are generally glued together, but may also be adhered using staples, rivets, or other similar attachment devices.

The process of manufacturing Bliss boxes first requires the creation of the three pieces of the box. The size and shape of the final box is determined by the dimensions of these pieces which are, in turn, determined by the ultimate product to be placed therein. Once these dimensions are determined, the appropriate method and amount of top flap overlap is determined, as well as the manner and amount of attachment of the side panels to the body matt.

Special Bliss box forming machines have been developed over the years to assemble these three paperboard pieces into the completed Bliss box. Different styles of such container-forming machines have been in existence for many years; however, such machines are generally limited to forming only the most basic of the many possible variations of Bliss boxes. Current Bliss box forming machines are designed to fold a body matt into a generally cubed shape, with little variation in width and depth. Such machines are generally designed to attach the two side panels to the body matt with the outside flaps of the side panels overlapping the corners of the body matt. A complicated formation and assembly of a non-standard Bliss box has heretofore been impracticable because of the inherent limitations in existing machines.

The need has now arisen for a large and elongated container capable of holding a sealed, flexible vessel containing several liters of fluid. Since such a vessel (or bag) filled with fluid would be quite heavy, it is important that the container into which it is placed have a great deal of structural strength. A modified Bliss-style container box provides the solution (See U.S. Pat. No. 5,419,485). Such a container should have longitudinal corner frame support provided in the body matt to give the final container greater strength. The container should also have bottom flaps on the ends of the side panels for adhesion to the inside of the bottom of the body matt. Then, for added bottom corner strength, the body matt itself could also have edge flaps at the bottom that fold up on the outside bottom corners over each of the end panels. Unfortunately, no existing Bliss box forming machine is capable of forming such an elongated, specially reinforced container.

Existing machines do not have sufficiently adjustable hoppers for the unusually shaped fiberboard parts needed for an elongated Bliss container box. Existing machines cannot provide the proper amount or location of adhesive material for application to the fiberboard surfaces. Existing machines cannot provide the necessary positioning of an elongated body matt in relation to the elongated side panels, and, in particular, cannot maintain the necessary separation of these parts until such time as they are ultimately pressed together to form the final container. Without such positioning and separation, improper and/or early adhesion of incorrect surfaces would result. Such a result would be almost unavoidable using existing machines to form an elongated Bliss container.

Current machines are also incapable of providing the added bottom strength elements of combining both (1) end panel flaps adhered to the inside of the bottom of the body matt, together with (2) body matt bottom flaps adhered over the outside bottom corners of the same end panels. It is therefore desirable to provide a single machine that can rapidly form a strong elongated Bliss style container box for holding a filled vessel containing several liters of fluid.

SUMMARY OF THE INVENTION

The present invention overcomes the aforementioned drawbacks of existing box forming machines and provides an improved machine that is capable of forming a strong, elongated Bliss style container box having either (1) elongated end panels with flaps adhered to the inside of the bottom of an elongated body matt; (2) body matt bottom flaps adhered over the outside bottom corners of the elongated end panels; or (3) both. The present invention includes an elongated, adjustable mandrel mounted in sliding relationship to a hopper area at one extreme, and a compression area at the opposite extreme. An overhead feed unit is provided above the slidable mandrel between the hopper area and compression area.

Bins for holding the unfolded end panels of the final container are provided on either side of the mandrel in the hopper area. Special adjustable sliding edge panels are provided on either side of the mandrel for positioning the fiberboard end panels for pre-folding prior to attachment to the body matt panel of the final container. Folding elements are provided adjacent to each of the sliding edge panels to perform the folding of the end panels once they are in position.

By means of a cooperating set of linkages, pivots, carriages, vacuums and cams, the machine of the present invention is able to perform repeated cycles, forming a container each time. First the mandrel cycles back into the hopper area. Each of two side bins provides a fiberboard end panel which comes into contact with the independently slidable edges of the mandrel. Just before the mandrel cycles forward, these edges push the fiberboard end panels forward where they are bent by the action of two folding elements. Meanwhile, a fiberboard body matt is brought into position in front of the retracted mandrel from the overhead feed unit. Adhesive material is sprayed onto selected parts of the body matt as it is placed into position in front of the mandrel.

As the mandrel cycles forward, the body matt is bent over into a C-shape as it is pushed into the compression area. At the same time, the now-folded end panels are pushed into close association with the middle of the body matt. In the compression area, a set of guides is provided for receiving the body matt and end panels of the container to be formed. In conjunction with the forwardly cycling mandrel, these guides bend and position the fiberboard body matt and end panel pieces inside an adjustable framework of compression surfaces. The framework of surfaces loosely surrounds the fiberboard pieces in order to avoid early adhesion until the mandrel is fully extended forward bringing the fiberboard pieces into proper position. Once positioned, the framework of surfaces, in conjunction with a movable end unit, collapses around and compresses the fiberboard pieces together to form the container box.

Following compression, the framework retracts, the end unit opens and the now-formed container is available for displacement from the machine. The mandrel is then ready to retract back into the hopper area to pick up new fiberboard pieces and start the cycle again to form another container.

It is therefore a primary object of the present invention to provide a machine capable of forming a three part fiberboard container.

It is a further important object of the present invention to provide a machine capable of forming an elongated three part fiberboard container having good corner and stacking strength.

It is a further important object of the present invention to provide a machine capable of forming an elongated Bliss style fiberboard container.

It is a further important object of the present invention to provide a machine capable of forming an elongated Bliss style fiberboard container for holding a sealed, flexible vessel containing several liters of fluid.

It is a further object of the present invention to provide a machine capable of forming a Bliss style fiberboard container having elongated end panels with flaps adhered to the inside of the bottom of an elongated body matt.

It is a further object of the present invention to provide a machine capable of forming an elongated Bliss style fiberboard container having a body matt with bottom flaps adhered over the outside bottom corners of the elongated end panels.

It is a further object of the present invention to provide a machine capable of forming an elongated Bliss style fiberboard container having elongated end panels with flaps adhered to the inside of the bottom of an elongated body matt and having a body matt with bottom flaps adhered over the outside bottom corners of the elongated end panels.

It is another primary object of the present invention to provide a machine for forming fiberboard containers having a specially adapted elongated movable mandrel which cycles between a set of fiberboard bins and a fiberboard compression area, the mandrel having slidable feed units on its sides for advancing fiberboard end panels for pre-positioning before the mandrel cycles forward to form a container.

It is another important object of the present invention to provide a machine for forming three part fiberboard containers having a specially adapted elongated movable mandrel which cycles between a set of fiberboard bins and a fiberboard compression area, the mandrel having slidable feed units on its sides for advancing fiberboard end panels for pre-folding against a set of movable elements before the mandrel cycles forward to form a container.

It is another important object of the present invention to provide a machine for forming fiberboard containers having fiberboard panel holding bins, adhesive applicators, a fiberboard panel compression unit, and an elongated movable mandrel which, cycles between the bins and the compression unit, the mandrel having slidable feed units on its sides for advancing fiberboard end panels for pre-folding against a set of retractable elements before the mandrel cycles forward to form a container.

It is another important object of the present invention to provide a machine for forming fiberboard containers having fiberboard panel holding bins, adhesive applicators, a fiberboard panel compression unit, and an elongated mandrel having slidable side feed units, a set of retractable pre-folding elements, and a set of special applicators for placing adhesive on selected parts of the fiberboard panels in order that they properly form a container when compressed together.

It is another important object of the present invention to provide a machine for forming fiberboard containers having fiberboard panel holding bins, adhesive applicators, a fiberboard panel compression unit, and an elongated mandrel having slidable side feed units, a set of retractable pre-folding elements, special adhesive applicators, and a set of special guides for folding and positioning the fiberboard panels as they are pushed by the mandrel into the compression unit.

It is another important object of the present invention to provide a machine for forming fiberboard containers having fiberboard panel holding bins, adhesive applicators, a fiberboard panel compression unit, and an elongated mandrel having slidable side feed units, a set of retractable pre-folding elements, special adhesive applicators, guides between the bins and the compression unit, and a set of movable compression surfaces at the end of the compression unit which close to form the container and open to allow the formed container to be removed.

It is another important object of the present invention to provide a machine for forming fiberboard containers having fiberboard panel holding bins, adhesive applicators, a fiberboard panel compression unit, and an elongated mandrel having slidable side feed units, a set of retractable pre-folding elements, special adhesive applicators, guides between the bins and the compression unit, movable end compression surfaces, and a slidable panel having a raised lip for removing completed, formed containers from the machine.

It is another important object of the present invention to provide a machine for forming fiberboard containers having hoppers for holding elongated fiberboard end panels, an overhead feed for supplying fiberboard body matt panels, an applicator for applying adhesive to selected places on the fiberboard panels, a compression unit for pressing the fiberboard panels together, a set of guides between the hoppers and the compression unit, a slidable mandrel which cycles between the hoppers and the compression area, slidable feed units on the sides of the mandrel for advancing the side panels ahead of the mandrel, retractable pre-folding elements adjacent to the feed advancing units in front of the retracted mandrel, movable compression surfaces at the end of the compression unit, and a device for removing completed, formed containers from the machine.

Additional objects of the invention will be apparent from the detailed descriptions and the claims herein.

DETAILED DESCRIPTION OF THE DRAWINGS

Figure 1:
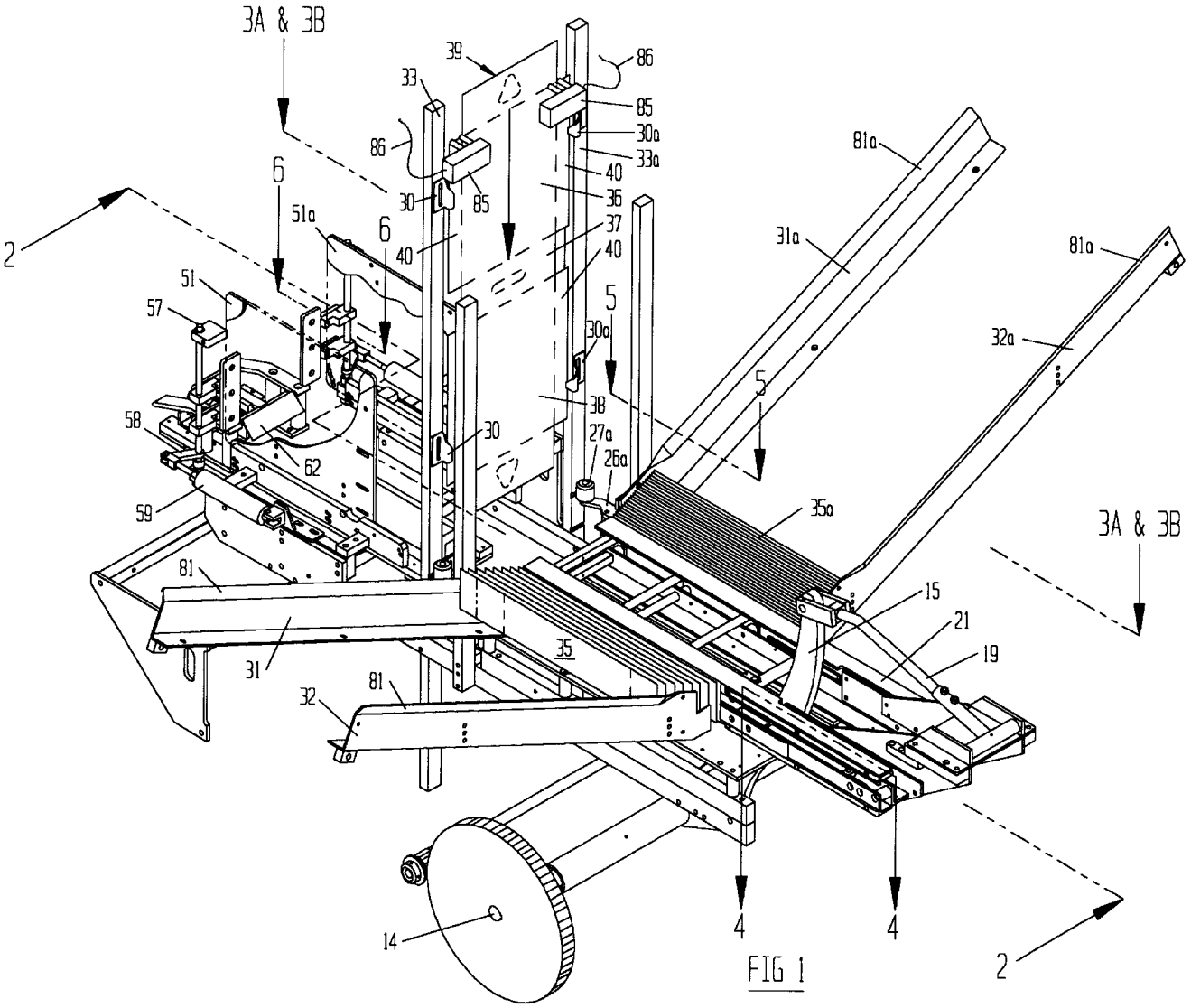
FIG. 1 is a perspective view of the operative parts of the machine of the present invention showing the mandrel fully retracted. The larger surrounding apparatus and supports are not shown.
Figure 2A:
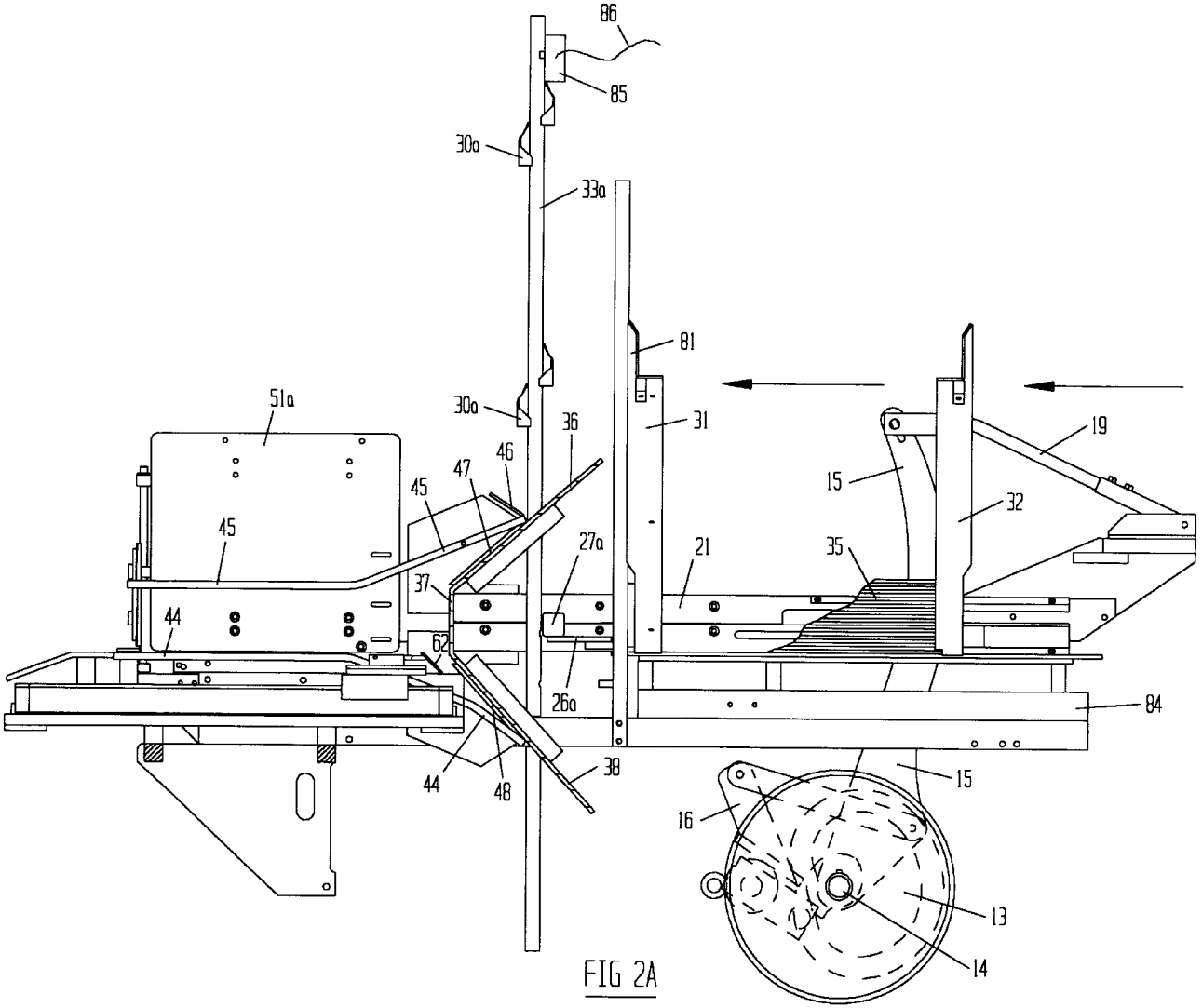
FIG. 2A is a partially cut-away side view along line 2—2 of FIG. 1 showing the mandrel partially extended forward, beginning the bending and folding of the fiberboard pieces into a container.
Figure 2B:
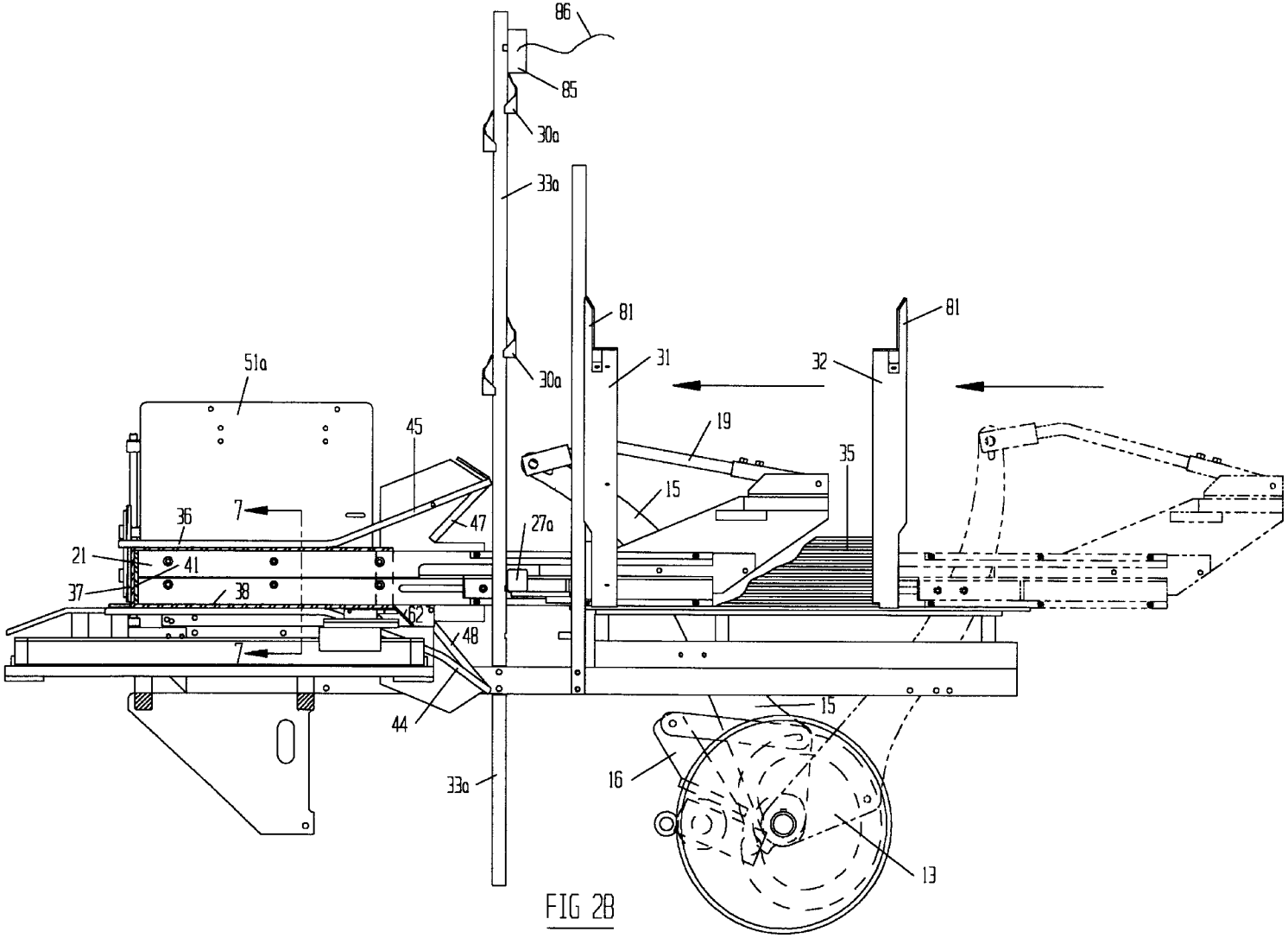
FIG. 2B is a partially cut away side view along line 2—2 of FIG. 1 showing the mandrel in the fully extended forward position. The phantom lines show the mandrel in the fully retracted position.

Referring to the drawings wherein like reference characters designate like or corresponding parts throughout the several views, and referring particularly to FIG. 1 it is seen that the operative portion of the invention includes an elongated mandrel 21 attached to one end of a movable lever 15 by means of pivotally attached rod 19. The opposite end of lever 15 is pivotally attached through a set of linkages 16 to pivot 14. Cam 13 causes the linkages 16 to impart a back and forth motion to lever 15 as it rotates around pivot 14. As such motion is imparted, pivotally attached rod 19 pulls mandrel 21 back and forth along a track 84. FIG. 2B shows mandrel 21 fully extended; the phantom lines of FIG. 2B show mandrel 21 fully retracted.

Containers are formed by the present invention around elongated mandrel 21. Mandrel 21 defines the inside dimensions and area of the containers to be formed. The elongated dimension of mandrel 21 defines the depth of the container; the height and width of mandrel 21 define the height and width of the container. Mandrel 21 is easily removed and may be replaced with one of many other elongated mandrels having new and different height, width and depth dimensions according to the container desired to be formed. The present machine is capable of using mandrels that are much wider and/or much higher (taller) and/or somewhat deeper than the example shown in the drawings herein.

Holding bins are provided either side of mandrel 21. Each bin is made up of a fixed generally L-shaped front flange 31 (and 31*a*) and an adjustable generally L-shaped rear flange 32 (and 32*a*). These flanges may be of varying lengths in order to hold large or small quantities of fiberboard end panels 35 (and 35*a*). Rear flanges 32, 32*a* may be easily adjusted closer to front flanges 31, 31*a* for shorter end panels, or farther from front flanges 31, 31*a* for longer end panels. Flanges 31, 31*a*, 32 and 32*a* are open at the top allowing them to hold tall end panels. Deflectors 81 (and 81*a*) on these flanges assist in stacking and loading panels 35 (and 35*a*).

A vertical overhead guide using posts 33 and 33*a* is provided in front of front flanges 31 and 31*a* for holding the fiberboard body matt panels 39. Guides 30 and 30*a* are provided along posts 33 and 33*a* to hold body matt panel 39 in a vertical position in front of mandrel 21. Body matt panels 39 are fed one by one into guides 30 and 30*a* from an overhead supply. As each body matt panel 39 comes into place, adhesive is applied at pre-selected critical locations, such as along flaps 40 and in the middle section 37. The adhesive is applied using sprayers 85 which are connected by wires 86 for control by electronic or physical switches in order to apply adhesive only to those areas (e.g. the middle 37 and flaps 40) of the body matt 39 that are expected to adhere to locations on the end panels 35 and 35*a*. After the adhesive is applied, body matt 39 is positioned such that its central region 37 (which will eventually form the bottom of the container) is directly across from the front plates 20 (and 20*a*) of mandrel 21.

Figure 3A:
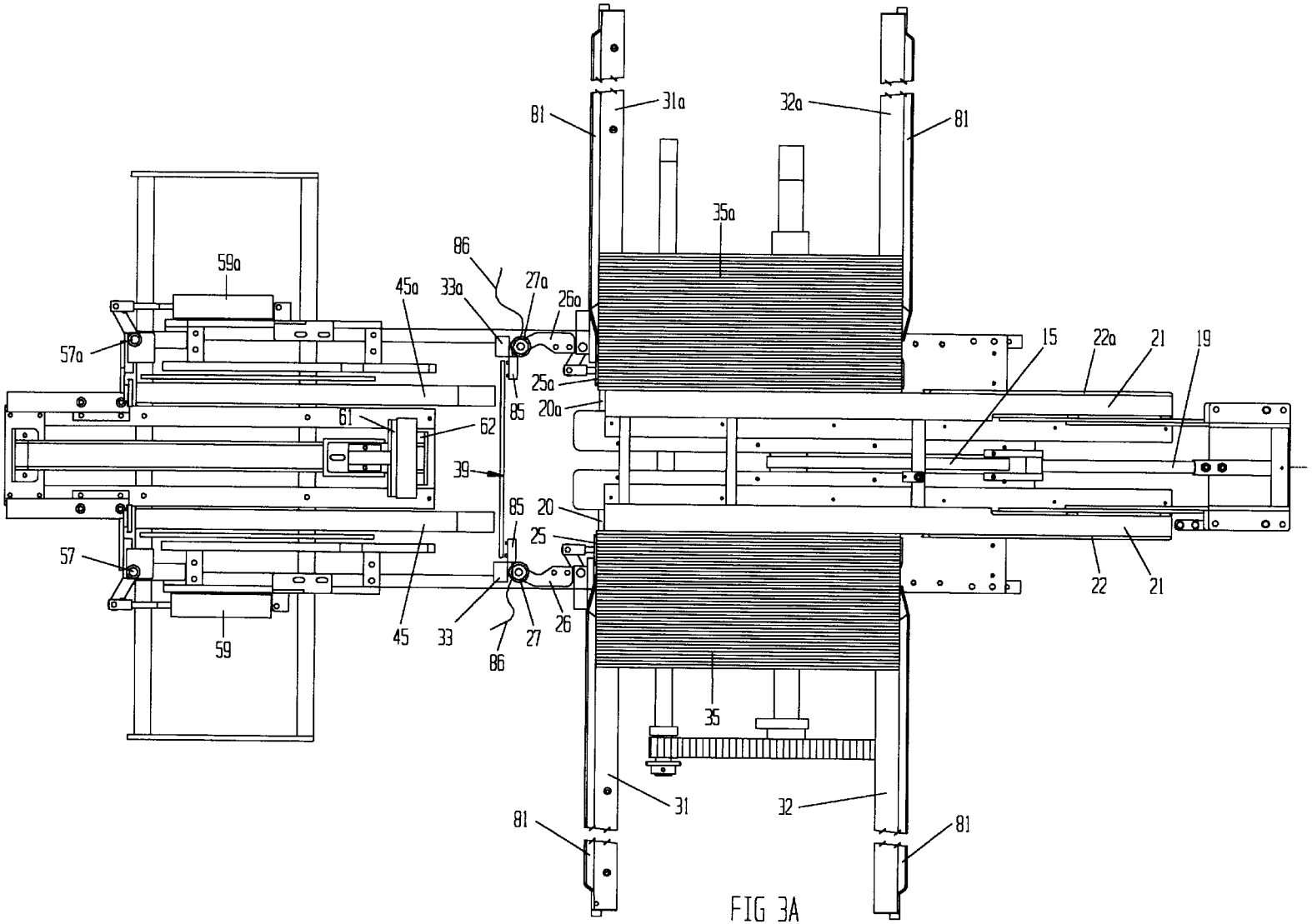
FIG. 3A is a fragmentary top view of the invention showing the mandrel and its slidable edge panels (picks) in a fully retracted position. The folding elements are also fully retracted.
Figure 3B:
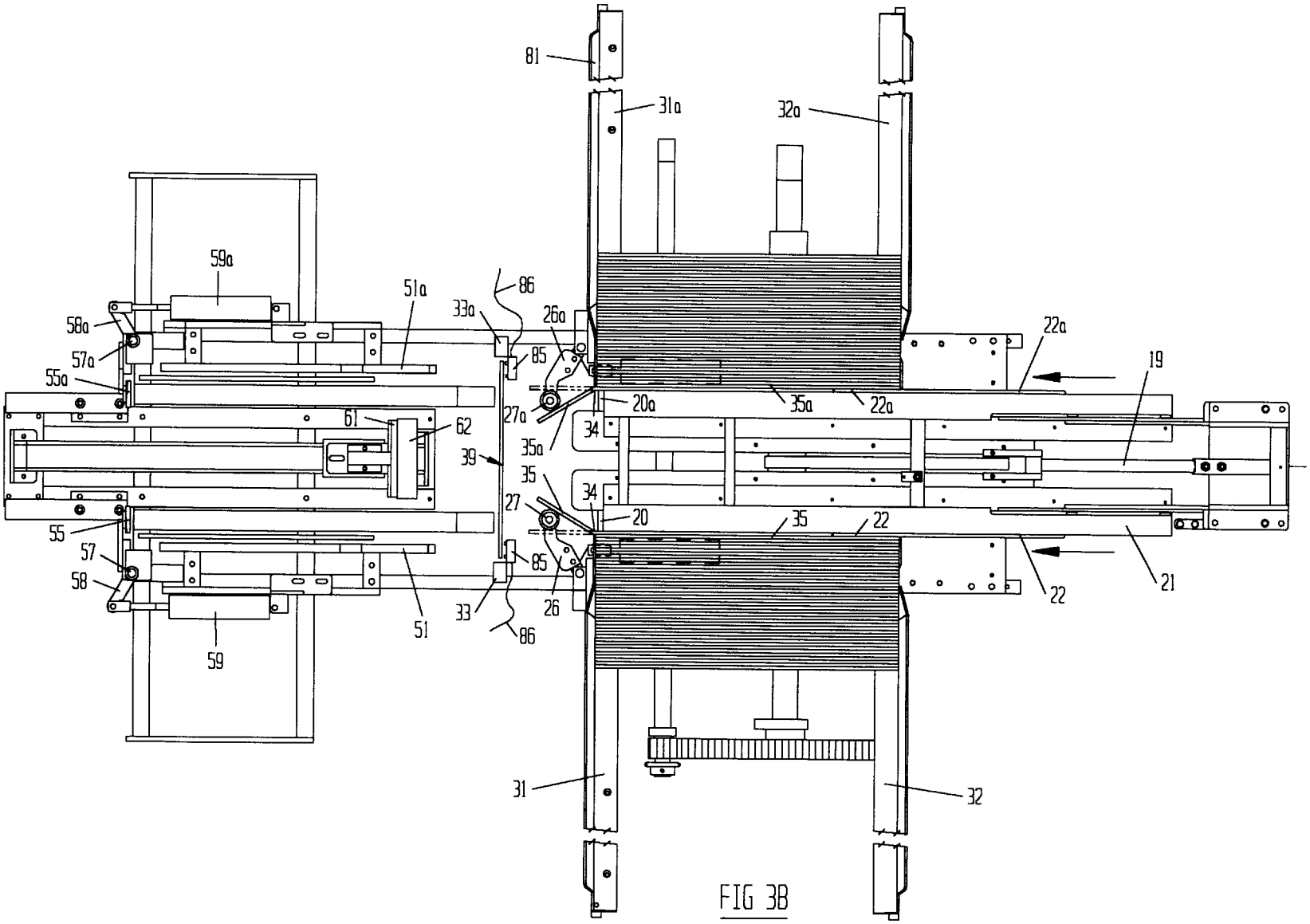
FIG. 3B is a fragmentary top view of the invention showing the mandrel still fully retracted as in FIG. 3A, but the slidable picks have advanced moving two fiberboard end panels forward. The retractable folding elements are shown in the process of pre-folding the advanced fiberboard end panels.

Referring to the fragmentary top views of FIGS. 3A and 3B, it is seen that mandrel 21 is in the fully retracted position. Advancing panels or picks 22 (and 22*a*) are provided on either side of and attached to mandrel 21. These picks are used to advance the fiberboard end panels 35 and 35*a* for pre-folding before mandrel 21 moves forward. FIG. 3A shows the picks 22 and 22*a* in the retracted position. FIG. 3B shows the picks 22 and 22*a* in the extended position. Adjustable stop plates 25 (and 25*a*) prevent all but one fiberboard end panel 35 and 35*a* on each side from advancing forward by the action of picks 22 and 22*a*.

Figure 4:
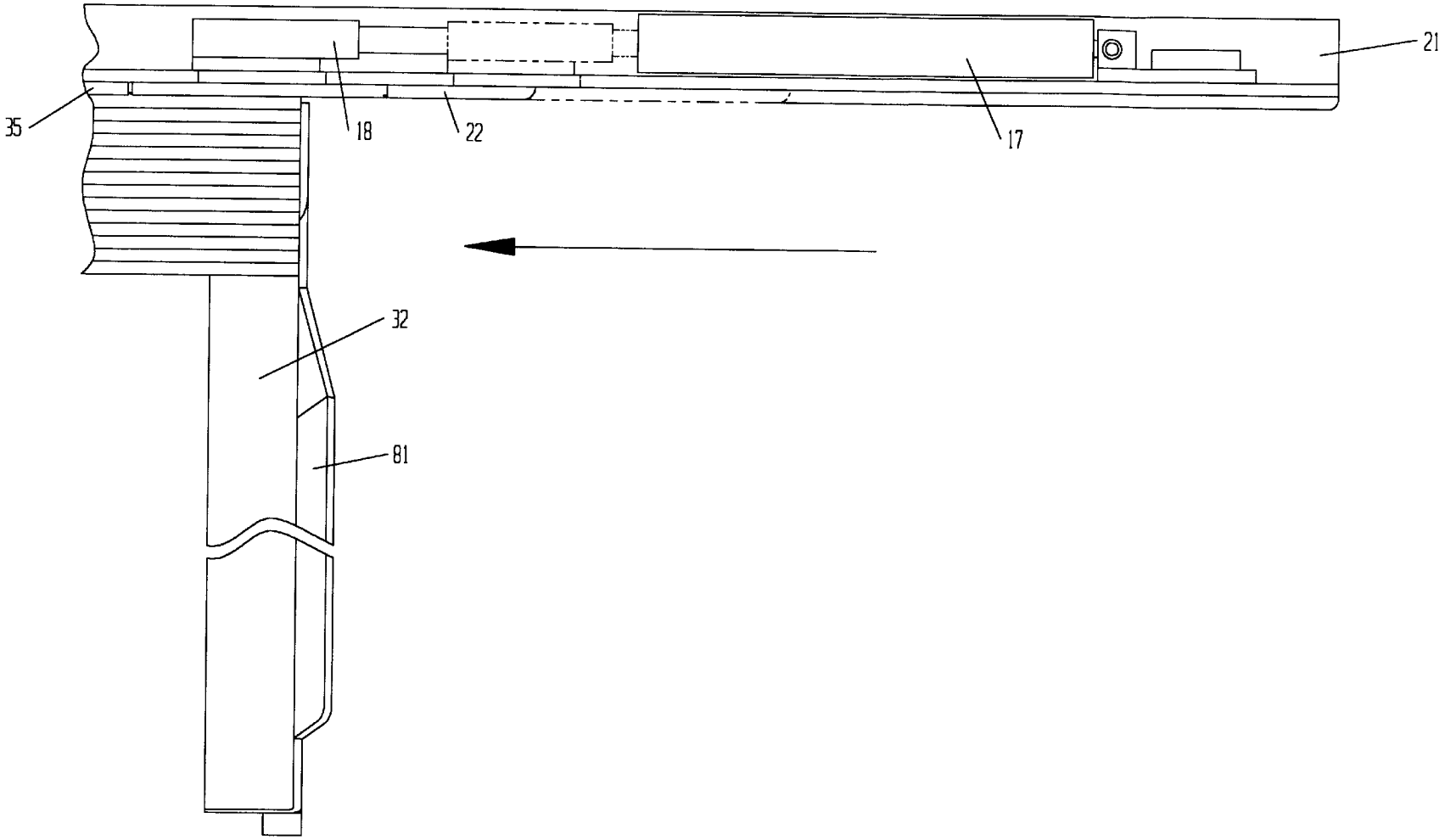
FIG. 4 is an enlarged partially cut away fragmentary detail top view along line 4—4 of FIG. 1 showing the operating mechanism of the slidable mandrel edge panels (picks).

FIG. 4 shows detail of the operation of pick 22. (The operation of pick 22*a* on the opposite side is identical to that of pick 22.) Pick 22 is mounted on the side of mandrel 21, and is attached to a rod 18 inside mandrel 21 which is operated by a motion imparting member such as a piston or other hydraulic mechanism 17. Member 17 is also mounted inside mandrel 21. Upon activation of member 17, rod 18 moves forward advancing pick 22 with it. Pick 22 then pushes the lowermost fiberboard panel 35 forward. Other panels 35 are prevented from movement by stop plate 25 (see FIGS. 3B and 5). The entire advancing panel assembly is part of and moves with mandrel 21 as it cycles back and forth.

Figure 5:
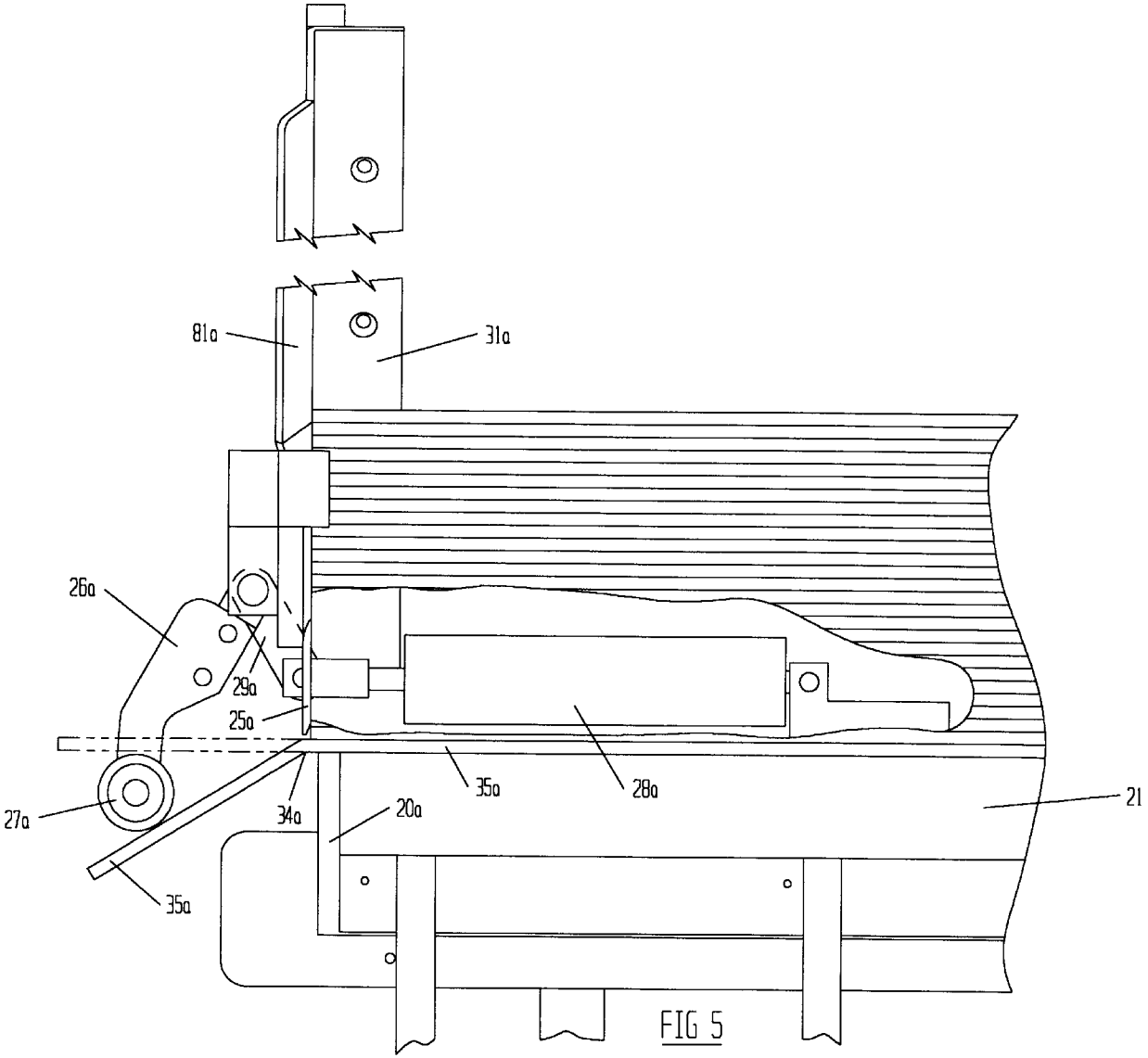
FIG. 5 is an enlarged partially cut away fragmentary detail top view of a pre-folding element in operation. Phantom lines show the fiberboard side panel before it is folded.

FIGS. 3A and 3B show the action of the pre-folding elements 27 (and 27*a*) in cooperation with picks 22 and 22*a*. Following the advance of fiberboard panels 35 and 35*a* by picks 22 and 22*a*, but before mandrel 21 begins to cycle forward, folding elements 27 and 27*a* pivot inward and then immediately retract back resulting in the formation of a fold or serve line 34 (and 34*a*) on fiberboard panels 35 and 35*a*. These folds 34 and 34*a* will eventually form two of the bottom corners of the finished container. FIG. 3B and FIG. 5 show the folding elements 27 and 27*a* in the inwardly pivoted position. The phantom lines show the position of fiberboard panels 35 and 35*a* before folding.

FIG. 5 shows detail of the operation of folding element 27*a*. (The operation of folding element 27 on the opposite side is identical to 27*a*.) As shown in FIG. 5, folding element 27*a* is attached to an adjustable arm 26*a* which is, in turn, attached through linkages 20*a* to a motion imparting member such as a piston or other hydraulic mechanism 28*a*. Activation of member 28*a* pulls linkages 20*a* moving pivotally rotating arm 26*a* in an inward direction bringing folding element 27*a* into contact with fiberboard panel 35*a* resulting in a fold in panel 35*a* at 34*a*. Member 28*a* then immediately retracts resulting in the retraction of element 27*a*. The same action occurs simultaneously on the opposite side of mandrel 21 involving element 27 and panel 35.

Following the folding action of elements 27 and 27*a*, mandrel 21 cycles forward eventually reaching the position shown in FIG. 2B. Picks 22 and 22*a* remain in their forwardly advanced position as mandrel 21 cycles forward, thereby moving folded side panels 35 and 35*a* forward as well. Before mandrel 21 cycles forward, the middle section 37 of body matt 39 is positioned directly across from front plates 20 and 20*a* of mandrel 21. Deflector 46 helps assure that body matt 39 drops into proper place. This positioning would not be seen behind guide post 33 in FIG. 2 (refer to FIG. 1 for perspective view).

Figure 7:
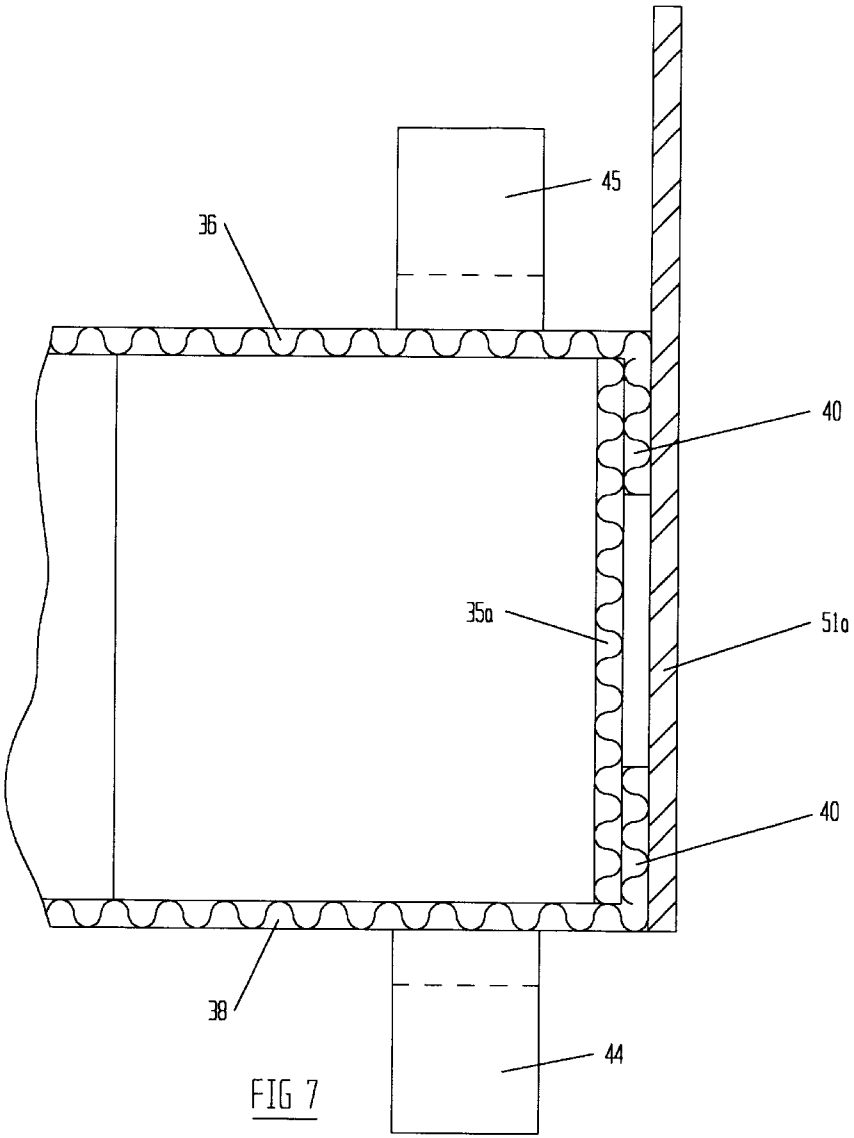
FIG. 7 is a fragmentary cross-sectional end view along line 7—7 of FIG. 2B showing the formation of corners on a container formed by the present invention.
Figure 8:
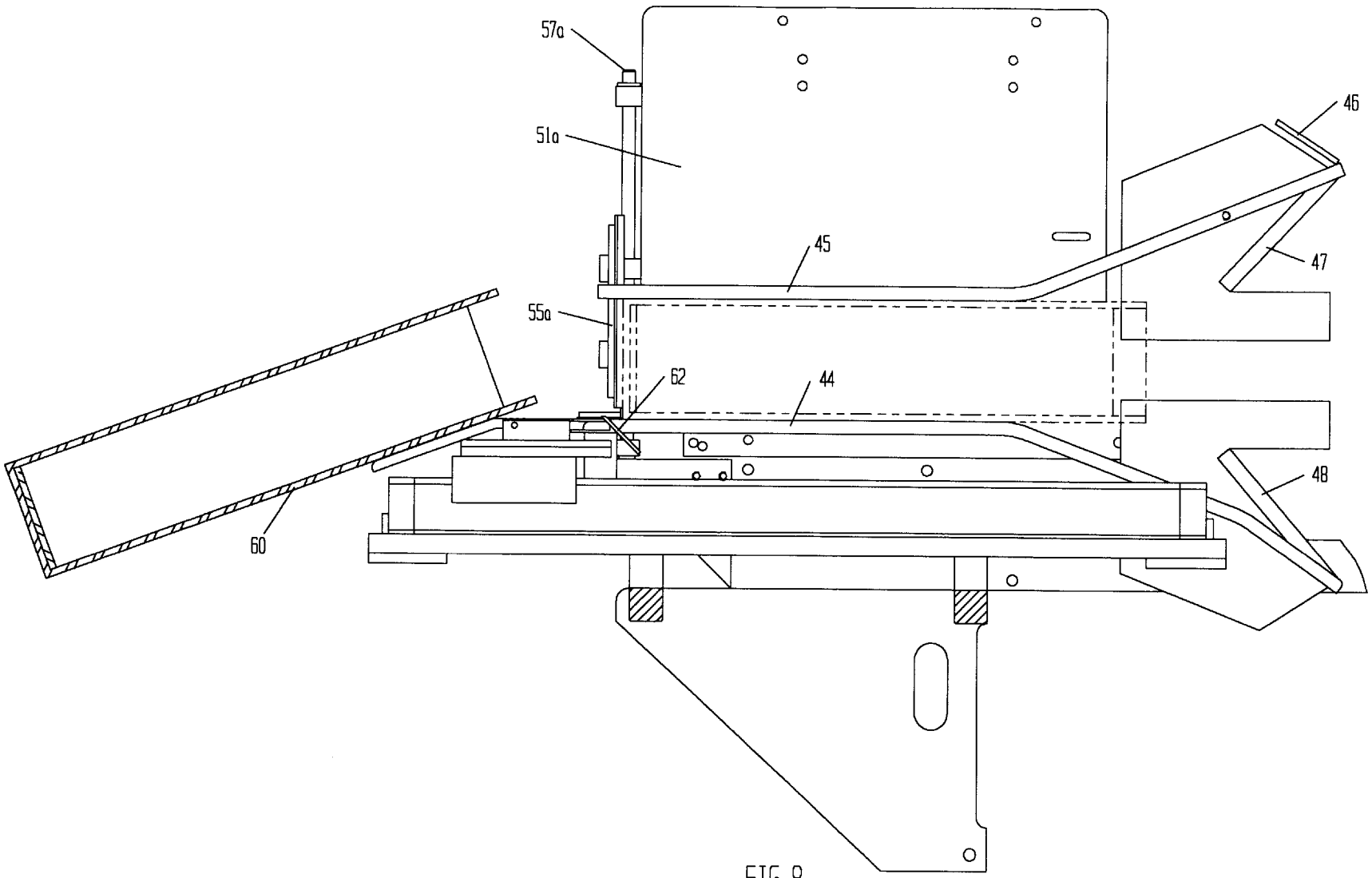
FIG. 8 is a partially cut away fragmentary side view of the compression area and the finished container ejection mechanism of the present invention.

As mandrel 21 cycles forward, it loosely pushes the folded ends of fiberboard panels 35 and 35*a* into the middle 37 of body matt 39 which will eventually form the reinforced bottom of the container. As the cycle continues, the upper 36 and lower 38 sections of body matt 39 are bent over by shoes 45 (upper) and 44 (lower) beginning the formation of, respectively the top and bottom of the final container (See FIG. 2A). At the same time, upper and lower corner plows 47 and 48 bend the flaps 40 of body matt 39 loosely around the edges of panels 35 and 35*a* forming the fold-over corners of the final container (See FIGS. 2A and 7). The bending of body matt 39 continues until mandrel 21 has cycled fully forward leaving the middle 37 of body matt in a vertical position, but changing the positions of upper and lower sections 36 and 38 to horizontal (See FIGS. 2B and 7).

By the time mandrel 21 had cycled fully forward, shoes 44 and 45, and plows 47 and 48 have placed fiberboard panels 39, 35 and 35*a* in close proximity to each other, but still only loosely fitted together. This prevents early adhesion of improper surfaces which could result in an improperly formed container.

A pair of adjustable compression plates 51 and 51*a* are provided on either side of shoes 44 and 45. When mandrel 21 is extended fully forward, it is surrounded on the top and bottom by shoes 44 and 45, and on either side by plates 51 and 51*a*. At this point, plows 47 and 48 have bent the fiberboard folds 40 of body matt 39 over both longitudinal edges of both end panels 35 and 35*a*. When mandrel 21 comes to a stop, compression plates 51 and 51*a* collapse against the sides of mandrel 21 tightly squeezing folds 40 against end panels 35 and 35*a* (See FIG. 7). These folds 40 were sprayed with adhesive when body matt 39 was first dropped into place, and have been kept away from close contact with end panels 35 and 35*a* until the squeezing action of plates 51 and 51*a*. The squeezing causes the adhesive to bond folds 40 to end panels 35 and 35*a* forming reinforced longitudinal corners on the container.

End door panels 55 and 55*a* are closed as mandrel 21 reaches full forward extension. The resistance of these door panels 55 and 55*a* against the front plates 20 and 20*a* of mandrel 21 firmly presses the folded ends of side panels 35 and 35*a* against the inside of the middle 37 of body matt 39. This pressure causes the adhesive on body matt 37 to bond to the folded ends of side panels 35 and 35*a* forming the bottom of the container.

Figure 9A:
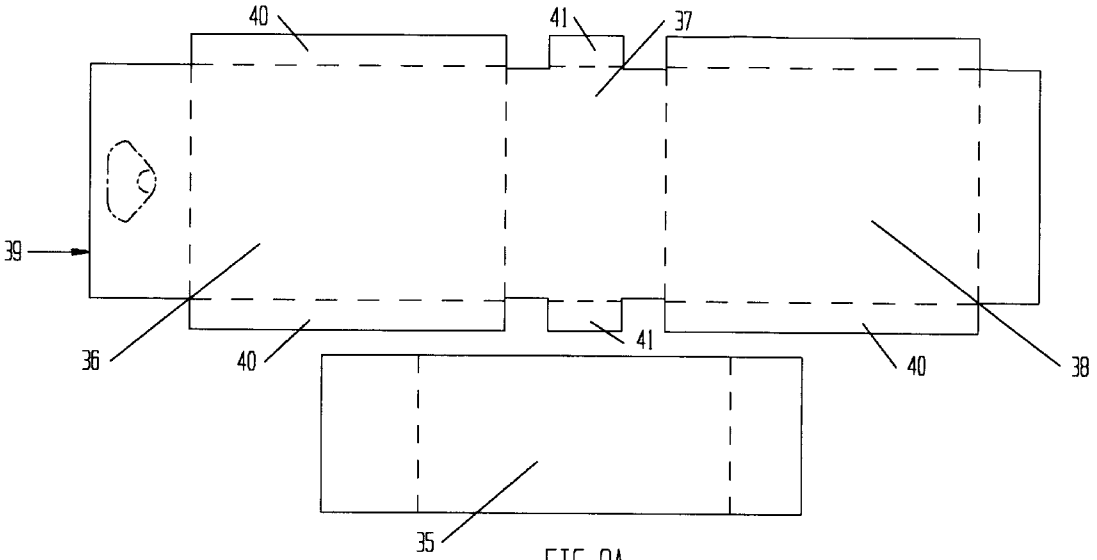
FIG. 9A shows a typical body matt blank and end panel blank used by the present invention to form a container in which certain body matt flaps fold over the outside bottom corners of the end panels to reinforce the bottom of the final container.
Figure 9B:
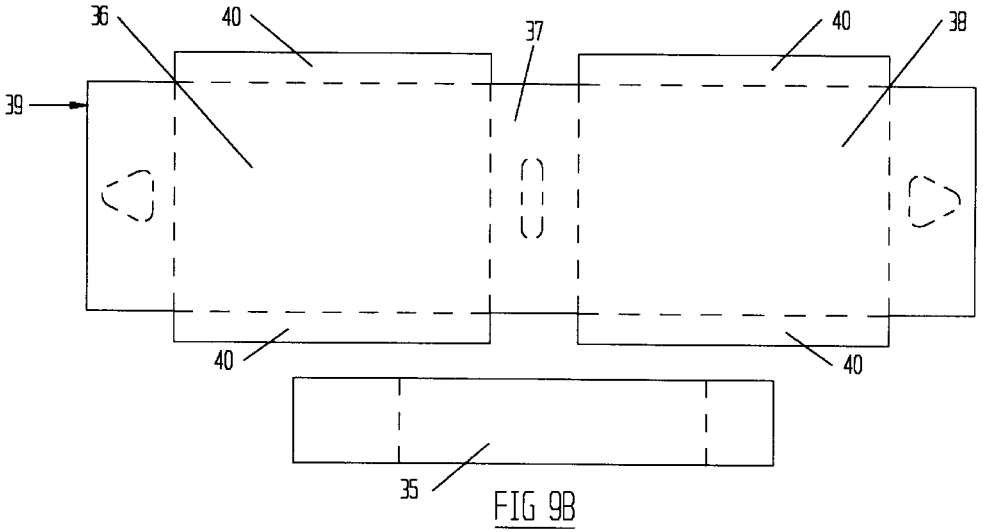
FIG. 9B shows a typical body matt blank and end panel blank used by the present invention to form a container in which the end panel flaps fold inside of the bottom of the body matt.

Additional flaps 41 may be provided in body matt 39 at the edges of the middle section 37 (see alternative body matt in FIG. 9A). Flaps 41 these may be folded over the outside of the bottom corners 34 and 34*a* of end panels 35 and 35*a* by the same pressure from plates 51 and 51*a* forming reinforced bottom edges. Of course, flaps 41 would be sprayed with adhesive at the same time flaps 40 were sprayed when body matt 39 was first put in place along guides 30 and 30*a*.

Figure 6:
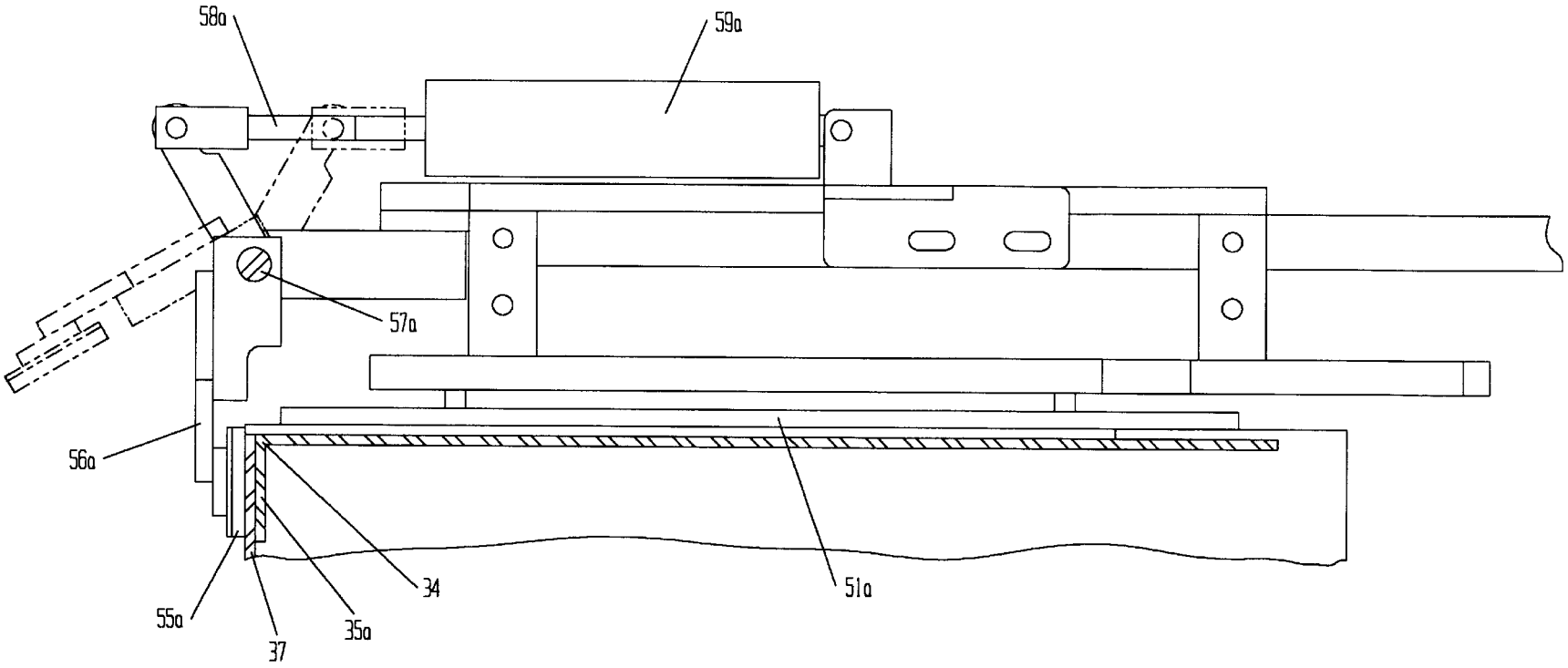
FIG. 6 is an enlarged partially cut away fragmentary detail top view of the compression area showing the operation of the compression plates and end pressure doors. The phantom lines show the end doors in an open position.

Detail of the operation of door panel 55*a* is shown in FIG. 6. Panels 55 and 55*a* may be removed and replaced with a differently sized or shaped panel in order to accommodate the formation of different sized containers. (The operation of panel 55 is identical to that of panel 55*a*.) Panel 55*a* is attached by an adjustable mount 56*a* to pivot 57*a* which is, in turn, attached through adjustable linkages 58*a* to a movement imparting member 50*a* such as a piston. As member 50*a* moves in and out, linkages 58*a* pull mount 56*a* around pivot 57*a* opening and closing door panel 55*a*.

Following compression, the now-formed container 60 is ready to be removed from the machine. This is accomplished by the action of a slidable panel 61 having a raised lip 62 thereon. As mandrel 21 retracts back to pick up more fiberboard panels to form the next container, panel 61 is pulled in the same direction until lip 62 is behind the end of newly-formed container 60. Adjustable stops on compression plates 51 and 51*a* prevent container 60 from being drawn back as mandrel 21 retracts. Meanwhile, door panels 55 and 55*a* open up. Then, before mandrel 21 cycles forward again lip 62 catches and pulls container 60 forward and out of the machine through open door panels 55 and 55*a*. Door panels 55 and 55*a* then close to provide the needed resistance to form the bottom of the next container.

DESCRIPTION OF THE PREFERRED EMBODIMENTS

In the preferred embodiment, the mandrel of the present invention is made of sturdy metal, such as aluminum. It should be easily removable and replaceable for different shaped containers, and each mandrel should have an opening in the middle to accommodate lever 15. The mandrel 21 slides on guides made of nylon or other similar material on a track underneath.

Holding bin flanges 31 and 32 should be made of lightweight but sturdy metal. They should have sufficiently wide support lips to hold the edges of end panels 35, and should be long enough to allow a supply of 50 or more panels on each side.

Overhead guide posts 33 should have sufficient length both above and below mandrel 21 to accommodate a wide variety of elongated body matts. Guides 30 and 30*a* should be adjustable in order to accommodate a wide variety of different thicknesses of fiberboard.

Mandrel advancing picks 22 and 22*a* should be made of lightweight metal, and should be adjustable to accommodate different advance distances for different sized fiberboard panels. The advancing mechanism should be a piston or other similar hydraulic device. Stop plates 25 and 25*a* should be adjustable to accommodate different thicknesses of fiberboard material.

Folding elements 27 and 27*a* should be rounded on the ends in order to avoid cutting or tearing the fiberboard panels when folding them. They should be easily removable and replaceable in order to effectively fold and accommodate different sized fiberboard panels. Elements 27 and 27*a* are made of nylon in the preferred embodiment, but may be made of plastic or metal.

The adhesive applicators 85 should be sprayers mounted on guide posts 33 and 33*a*. They may be controlled electronically using sensors and switches which are activated according to the position of the body matt 39 at it passes through guides 30 and 30*a*.

Compression plates 51 and 51*a* should be made of non-stick material in order to avoid adhesion to the fiberboard pieces of the container. These plates define the largest sized container that the machine will form, and are tall enough to provide pressure to very large side panels. Removable end door panels 55 and 55*a* are preferably made of nylon, but can be made of any non-stick material. They should be able to fully retract into a completely clear position that will allow the finished container to be easily removed from the machine. They may be activated using pistons or other similar hydraulic devices.

In use, the dimensions and style of the container to be formed must first be selected. Then, the appropriately cut body matt and end panels are loaded into the machine. This requires selecting and installing the proper mandrel, and then properly adjusting all of the following, among other things: (1) the sizes of the end panel bins using rails 32 and 32*a*; (2) the width and placement of the body matt guides 33; (3) the sprayers and controls for application of adhesive; (4) the length of advancement on the mandrel side panel picks 22 and 22*a* so that folds 34 are in the proper location; (5) the position of stop plates 25 and 25*a*; (6) the positioning of shoes 44 and 45 as well as plows 47 and 48; (7) the location of the pressure plates 51 and 51*a* as well as end doors 55 and 55*a* for proper compression; and (7) the location of the removal panel 61. Many other adjustments are also made for proper operation of the machine.

The machine begins with mandrel 21 retracting between the end panel bins. The two fiberboard panels on either side are first advanced by picks 22 and 22*a*, and then folded by elements 27 and 27*a* while the body matt 39 drops into place. Adhesive is applied to pre-selected locations on the body matt as it drops. Then, mandrel 21 moves forward bending the body matt over into a C-shape through shoes 44 and 45, and forcing the folded end panels 35 and 35*a* loosely against it. Plows 47 and 48 fold the corners 40 of the body matt over the end panels 35 and 35*a*. The end doors 55 and 55*a* of the compression area close, and when the mandrel is fully extended, the side pressure plates 51 and 51*a* collapse against the bent fiberboard pieces compressing and molding them against the mandrel. This causes the adhesive surfaces to bond forming the finished container. The end doors open, and as the mandrel retracts for the next set of fiberboard pieces, a lipped underpanel 62 catches the edge of the newly-formed container. Then, just before the mandrel cycles forward to form the next container, the finished container is displaced from the machine to be put into use.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. An improvement to an apparatus for forming a bliss-style container having an elongated removable mandrel movably mounted on a path, an overhead feed located at approximately the middle of said path for supplying a first part of the container to be formed into said path, said feed including a means for applying adhesive to certain defined areas on said first container part, hopper means along said path on both sides of said mandrel for supplying, respectively, second and third parts of the container to be formed to the sides of said mandrel prior to forward motion of said mandrel, and a plurality of compression plates along said path downstream from said feed, the improvement comprising:

a. means for advancing said second and third parts relative to said mandrel prior to forward motion of said mandrel located on either side of said mandrel;

b. means for pre-folding leading edges of said second and third parts after advancement relative to said mandrel, said pre-folding means being located between said hopper means and said overhead feed; and c. at least one adjustable closable end door provided at the end of the path near the compression plates for pressing the ends of the container parts together, whereby the leading edges of said second and third parts are adhered to the inside of the middle of said first part forming the bottom corners of the container.

2. An apparatus for forming a container comprising a mandrel movably mounted on a path, means for delivering two side panels to the sides of said mandrel prior to forward motion of said mandrel, a means located downstream from said side panel delivery means for delivering a body panel into the path of said mandrel prior to forward motion of said mandrel, means for applying adhesive to said body panel as it is delivered, means located on the sides of said mandrel for advancing said side panels relative to said mandrel prior to forward motion of said mandrel, means for pre-folding said side panels located on said path downstream from said side panel delivery means, means for deforming said body panel around said side panels located on said path downstream from said body panel delivery means, and means located downstream from said deforming means for compressing said side and body panels together to form a container.

3. An apparatus for forming a bliss-style container with reinforcement on the inside corners of the bottom of such container comprising a mandrel movably mounted on a path, an overhead feed for supplying a first part of the container to be formed into the path of said mandrel, said feed including a means for applying adhesive to certain defined areas on said first container part, hopper means along said path on both sides of said mandrel for supplying, respectively, second and third parts of the container to be formed, means for advancing said second and third parts relative to said mandrel prior to forward motion of said mandrel, said advancing means being located on either side of said mandrel, means for pre-folding the leading edges of said second and third parts after advancement relative to said mandrel, said pre-folding means being located between said hopper means and said overhead feed, a plurality of compression plates along said path downstream from said feed, and at least one adjustable closable end door provided at the end of the path near the compression plates for pressing the ends of the container parts together.

4. The invention described in claim 3 wherein the advanced edges of said second and third parts are adhered to the inside of the middle of said first part forming the bottom corners of the container.

5. An apparatus for forming a container comprising an elongated removable mandrel slidably attached to a track, means for cyclically moving said mandrel back and forth along said track on a path that is longer than said track, an overhead feed mechanism located at approximately the middle of said path for supplying the body panel of a container to be formed, said feed mechanism including a means for applying adhesive to certain defined areas on said body panel, hoppers along said path on both sides of said mandrel for supplying pre-scored side panels of the container to be formed, slidable members located on the sides of said mandrel including a means for sliding the members relative to said mandrel for advancing the side panels relative to the mandrel prior to forward motion of said mandrel, pivotally mounted elements located between the hoppers and the overhead feed for pre-folding pre-scored ends of said side panels after advancement by the slidable members, and a plurality of compression plates along said path on the opposite side of said feed mechanism from said hoppers for compressing the side panels and body panel together around the mandrel.

6. The apparatus described in claim 1 wherein a plurality of adjustable guides are provided between said feed mechanism and said compression plates for bending the side and body panels into a defined shape as said mandrel cycles forward.

7. The apparatus described in claim 6 wherein adjustable closable end doors are provided at the end of the path near the compression plates for compressing the pre-folded ends of the side panels against the inside of the middle of the body panel.

8. The apparatus described in claim 7 wherein an adjustable means for removing a finished container from said machine is provided on the path below the compression plates.

9. The apparatus described in claim 7 wherein said mandrel defines the interior area of the container to be formed, said area having a depth dimension that is greater than its width dimension.

10. The apparatus described in claim 7 wherein the means for applying adhesive is comprised of a plurality of sprayers each controlled by electronic means for application of adhesive to pre-selected locations on said body panel.

11. The apparatus described in claim 7 wherein said feed mechanism, hoppers, slidable members, pivotally mounted elements, and adhesive applying means are all adjustable.

12. The apparatus described in claim 7 wherein one end of a movable lever is pivotally attached through a linkage to said mandrel and the opposite end of said lever is pivotally attached through a second linkage to a rotatable cam means.

13. The apparatus described in claim 1 wherein the edges of said advanced side panels are adhered to an inside of the middle of said body panel forming the bottom corners of the container.

14. The apparatus described in claim 1 wherein the means for sliding the members relative to the mandrel is a hydraulic motion imparting mechanism.

15. The apparatus described in claim 1 wherein the means for sliding the members relative to the mandrel is a moveable piston and rod assembly.

16. An apparatus for forming a container comprising:

a. an elongated removable mandrel having a front and no less than two sides movably mounted on a path;

b. means for cyclically moving said mandrel along said path;

c. a pair of hoppers located on opposite sides of said mandrel path at one end thereof for holding pre-scored container side panels;

d. a pair of independently slidable advancing members attached to opposite sides of said mandrel including a means for sliding the members relative to said mandrel for engaging the lowermost side panel from each of said hoppers and advancing such panels forward relative to the mandrel prior to forward movement of the mandrel;

e. a pair of movable pre-folding elements pivotally mounted on opposite sides of the path of said mandrel downstream from said hoppers for folding said advanced side panels along pre-scored lines after advancement by the pair of independently slidable advancing members;

f. an overhead container part feed mounted along said path downstream from said pre-folding elements for supplying container body panels having a plurality of flaps thereon for engagement over said pre-scored side panels as the mandrel cycles forward;

g. controllable means located on said overhead feed for applying adhesive to selected areas of said body panels prior to forward movement of the mandrel; and h. movable compression plates located along said path at the end opposite said hoppers for compressing the side panels and body panel together around the mandrel in order to bond the adhesive and form the sides of a container.

17. The apparatus described in claim 16 wherein a plurality of container forming plows are provided along said path between said feed mechanism and said compression plates for bending said body panel and folding said flaps over said side panels as said mandrel cycles forward.

18. The apparatus described in claim 16 wherein adjustable closable end doors are provided at the end of the path in front of said mandrel for compressing the middle of the body panel against the folded side panels in resistance to the forward motion of said mandrel in order to form the bottom of the container.

19. The apparatus described in claim 16 wherein an adjustable means for removing a finished container from said machine is provided on the path below the compression plates.

20. The apparatus described in claim 16 wherein one end of a movable lever is pivotally attached through a linkage to said mandrel and the opposite end of said lever is pivotally attached through a second linkage to a rotatable cam means.

21. The apparatus described in claim 16 wherein the edges of said advanced side panels are adhered to an inside of the middle of the body panel forming the bottom corners of the container.

22. A method for forming a container of a type having two side panels attached to a body panel using a machine having a mandrel movably mounted on a path comprising the steps of:

a. delivering two side panels to the sides of said mandrel prior to forward motion of said mandrel;

b. delivering a body panel into the path of said mandrel prior to forward motion of said mandrel;

c. applying adhesive to said body panel as it is delivered;

d. activating a means for advancing said side panels relative to said mandrel located on the sides of said mandrel thereby advancing the side panels relative to the mandrel prior to forward motion of said mandrel;

e. moving said mandrel forward along said path;

f. activating a means for pre-folding said advanced side panels located on said path downstream from said side panels but upstream from said body panel;

g. pushing said advanced, pre-folded side panels into said body panel;

h. deforming said body panel around said side panels; and i. closing a plurality of compression plates around said side and body panels to form a container.

23. The method of claim 22 wherein a plurality of guides are provided downstream from the delivery of said body panel for bending the corners of said body panel over said side panels as said mandrel cycles forward.

24. The method of claim 22 wherein adjustable closable end doors are provided downstream from the compression plates for pressing the ends of the container panels together.

25. The method of claim 22 wherein a final step comprises removing a finished container from said machine.

26. The method of claim 25 wherein an adjustable means for removing a container from the machine is provided downstream from said compression plates.

27. The method described in claim 22 wherein the edges of said advanced side panels are adhered to the inside of the middle of said body panel forming the bottom corners of the container.

* * * * *